US006253513B1

(12) United States Patent
Saida

(10) Patent No.: US 6,253,513 B1
(45) Date of Patent: Jul. 3, 2001

(54) TILE PANEL AND DRY EXECUTION METHOD FOR WALL SURFACE USING TILE PANELS

(75) Inventor: Yasunori Saida, Nagoya (JP)

(73) Assignee: Daiei Corporation CO, LTD, Aichi-pref (JP)

( * ) Notice: Subject to any disclaimer, the term of this patent is extended or adjusted under 35 U.S.C. 154(b) by 0 days.

(21) Appl. No.: 09/392,116

(22) Filed: Sep. 8, 1999

(30) Foreign Application Priority Data

Feb. 22, 1999 (JP) ..... 11-43322

(51) Int. Cl.[7] ..... E04F 13/08
(52) U.S. Cl. ..... 52/392; 52/384; 52/747.1
(58) Field of Search ..... 52/384, 385, 390, 52/391, 392, 746.1, 746.12, 747.1, 747.11

(56) References Cited

U.S. PATENT DOCUMENTS 2,005,380 * 6/1935 Marsh et al. ..... 52/392
2,223,721 * 12/1940 Ernstoff ..... 52/385 X
2,997,142 * 8/1961 Engholm ..... 52/392 X
5,014,488 * 5/1991 Evangelos et al. ..... 52/384 X

FOREIGN PATENT DOCUMENTS

2102421 * 4/1972 (FR) ..... 52/384
645479 * 11/1950 (GB) ..... 52/392
5729755 2/1982 (JP) .
8333862 12/1996 (JP) .

* cited by examiner

*Primary Examiner*—Peter M. Cuomo
*Assistant Examiner*—James O. Hansen
(74) *Attorney, Agent, or Firm*—Pearson & Pearson, LLP

(57) ABSTRACT

A plurality of tile panels suited for dry execution for a wall surface. Each tile panel is integrally formed by bonding a plate onto a back surface of a tile and a plurality of restriction blocks are disposed on coupling pieces of at least two opposite side edges of the plate in a tightly attached manner. The restriction blocks are positioned on the side edges of the plate so as to not overlap with each other when the tile panels are aligned vertically and horizontally. The coupling pieces protrude beyond a tile bonding range on the plate. Rivet holes, a nail hole, and a screw hole for an adjuster bolt are provided in each of the restriction blocks.

5 Claims, 4 Drawing Sheets

3
15
15
1
5
12
6
13
13
6
5
4
5
6
4
6
12
2

11
16
9
8
5
8
10
6
8a
8a
7
10a
9a
7
4

TILE PANEL AND DRY EXECUTION METHOD FOR WALL SURFACE USING TILE PANELS

BACKGROUND OF THE INVENTION

1. Field of the Invention

The present invention relates to a tile panel suited for dry execution for a wall surface and a dry execution method for a wall surface using the tile panels.

2. Description of the Related Art

Tiles look awkward if they are not arranged to have a uniform joint width and a uniform tile surface. In addition, strong bonding power is required for high-rise buildings.

It requires expertise to arrange ordinary tiles to provide uniform joints and a uniform surface and to bond tiles with mortar is so-called wet execution. Due to this, the tiles tend to slip downward by, for example, their own weight until mortar is solidified, it takes time to complete tiling and it is difficult to ensure bonding power required for high-rise buildings or the like.

In addition, in case of modifying, for example, a board external wall to a tiled wall, it is necessary to peel off the board external wall and then to form a backing, which makes operation disadvantageously laborious.

Considering this, there are known and proposed tile siding for bonding thin tiles onto the surface of a lightweight base material as described in, for example, Japanese Patent Unexamined Patent Application Publication No. 8-333862, a joint-added tile with which a joint can be formed by extending small-width portions corresponding to the joint on the side piece of a tile in advance and tight combining the portions, as described in Japanese Patent Unexamined Application Publication No. 57-29755 and the like.

A tile bonded decorative board can be made by dry execution method and the decorative board is difficult to discriminate from a tiled wall onto which tiles are directly bonded at glance. These boards are worked for various types of constructions. However, while use of a combination of many small tiles is well known, we have never heard that a tile panel employing only one large tile has been put to practical use.

The reasons are considered to be as follows. If emphasis is put on workability and bonding power, quite naturally, the sizes of tiles used for siding are limited and there is no other choice but to use small-size tiles; and it is difficult to ensure sufficient bonding power. As a result, the worked surface onto which small tiles are bonded cannot stand comparison with that onto which large tiles are bonded.

As for use of joint-added tiles, by contrast, anyone can ideally arrange the joint-added tiles and can stand comparison with experts. However, if a board is bonded onto a to-be-executed surface, it is required to remove the board, to change it to a mortared surface or to form a backing structure, irrespectively of wet or dry execution. Thus, it can be said that joint-added tiles are not suited for modification.

BRIEF SUMMARY OF THE INVENTION

The present invention is an execution technique for a wall surface suited for not only new constructions but also modifying the external wall of an already constructed building.

DESCRIPTION OF THE EMBODIMENT

A tile panel and an execution method for a tiled wall surface according to the present invention will be described with reference to the drawings.

Figure 1:
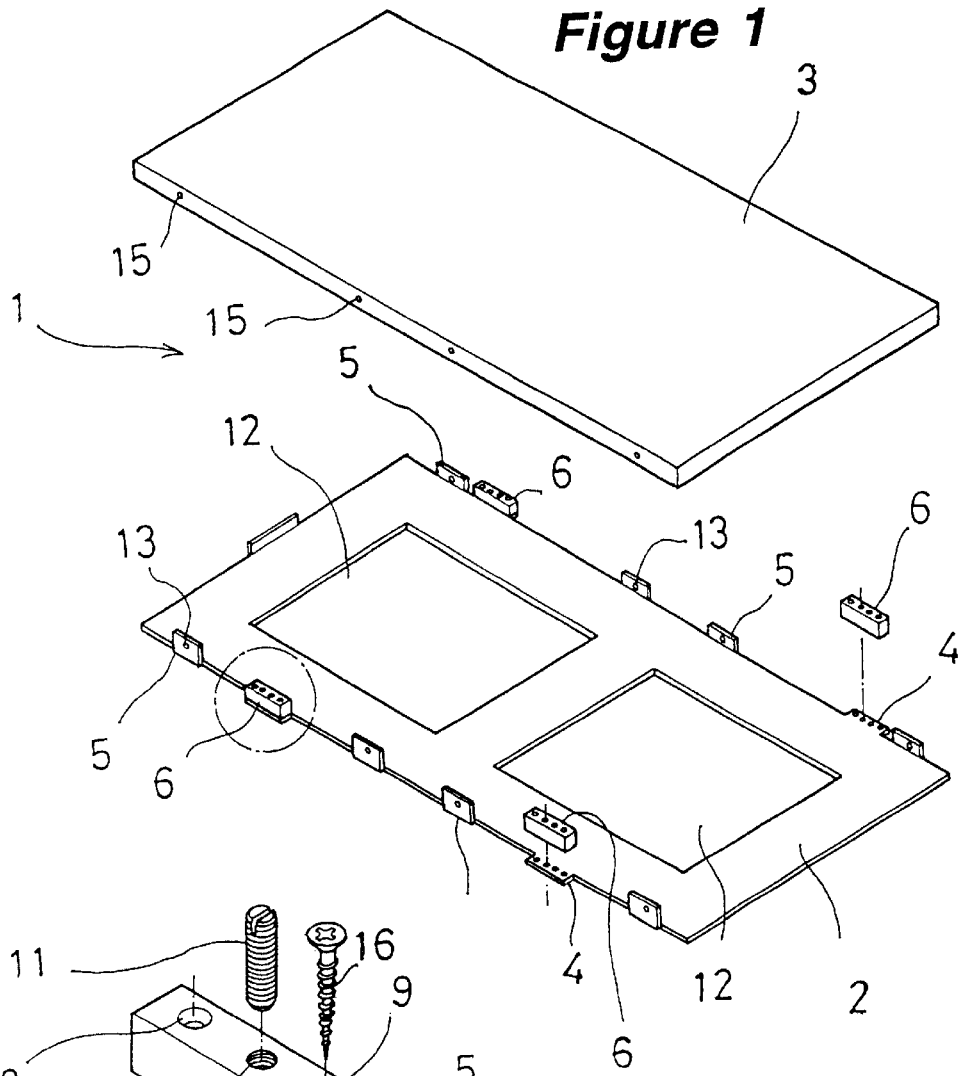
FIG. 1 is a perspective view of an embodiment according to the present invention, showing an exploded view of a tile panel.
Figure 2:
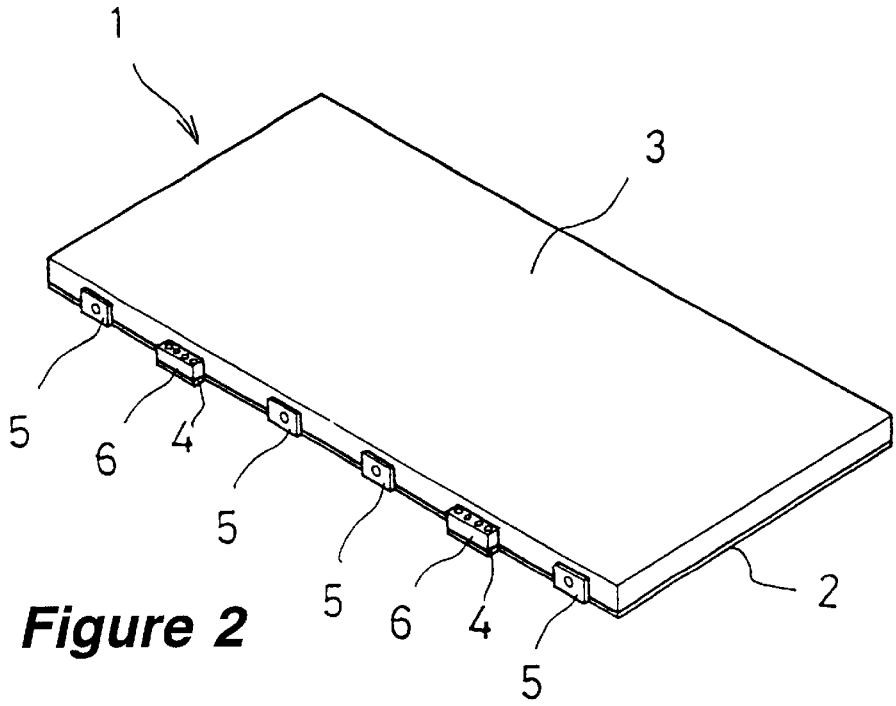
FIG. 2 is a perspective view of an embodiment of a tile panel according to the present invention.

FIGS. 1 and 2 shows an example of a tile panel. As shown therein, a tile panel 1 is integrally formed by bonding a plate 2 onto the back surface of a tile 3. Stone material of 30 cm long by 60 cm broad by 12 cm thick is used for the tile 3.

The plate 2 is made of stainless steel and provided with a plurality of coupling pieces 4 and a plurality of raising pieces 5 around an area onto which the tile 3 is bonded. The coupling piece 4 has a length of 4 cm and a width set at 7 mm which becomes a joint width during working. The height of the piece 4 is kept about 5 mm and is smaller than the thickness of the tile 3.

Figure 3:
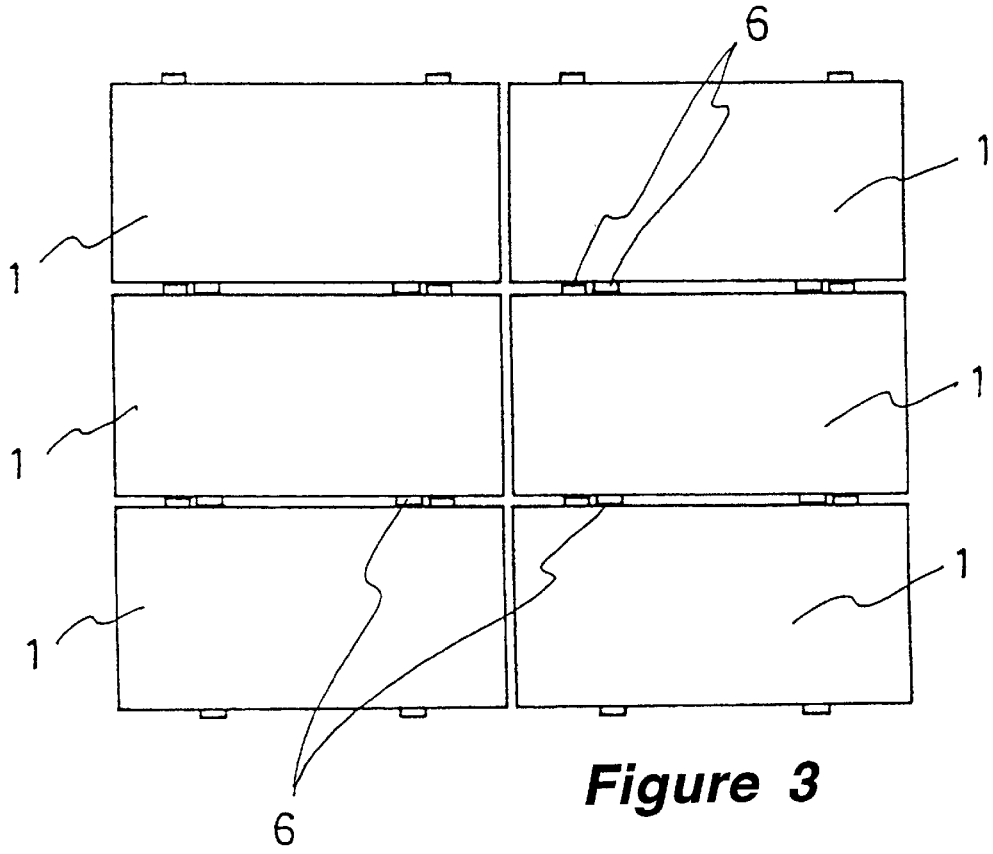
FIG. 3 is a front elevational view of a tile panel bonding pattern.
Figure 4:
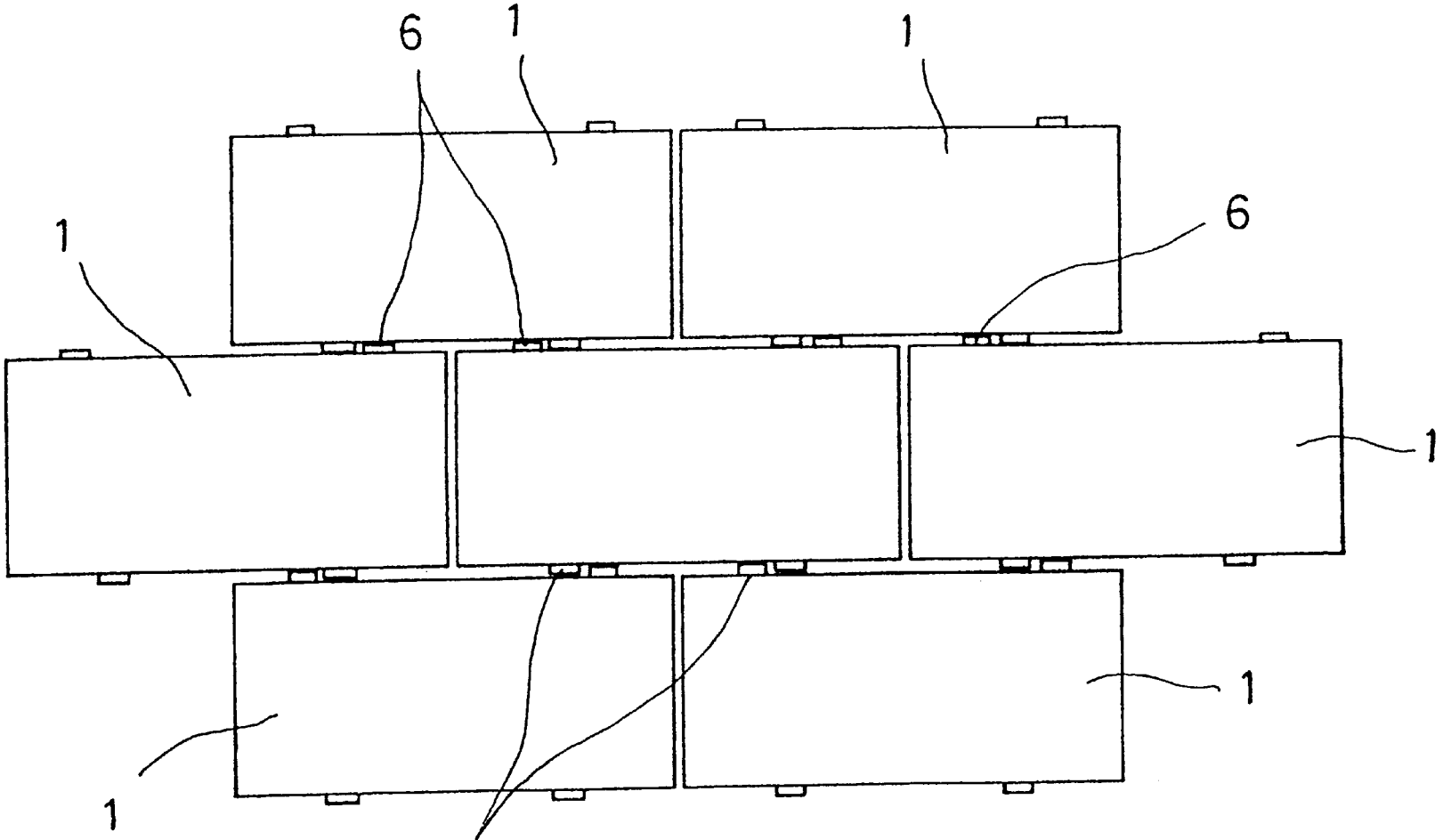
FIG. 4 is a front elevational view of a tile panel bonding pattern.

The coupling piece 4 is formed at the upper and lower edges of the tile to protrude beyond a tile bonding range. The protruding positions are selected not to overlap with each other if the tile panels 1 are aligned vertically and horizontally as shown in FIG. 3 or the tiles 1 are arranged to be shifted from each other vertically by a half length of the tile panel 1 as shown in FIG. 4.

Reference numeral 6 denotes a restriction block, which is fixedly attached to the coupling piece 4 by rivets 7, 7 in a state in which the restriction block 6 is tightly attached to the side of the tile 3.

Figure 1A:
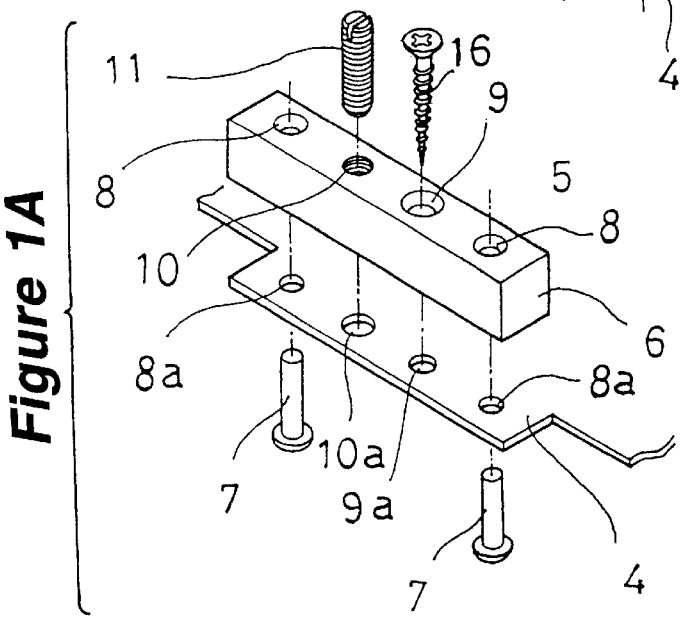
FIG. 1A is an exploded perspective view of a portion of a plate having a restriction block disposed thereon.

Referring to FIG. 1A, the restriction block 6 is provided with rivet insertion holes 8, 8, a nail hole 9 and a screw hole 10 for an adjuster bolt 11. A coupling piece 4 is provided with transparent holes 8*a*, 8*a*, 9*a* and 10*a* at positions corresponding to the rivet insertion holes 8, 8, the nail hole 9 and the screw hole 10 for an adjuster bolt 11, respectively. The adjuster bolt 11 is screwed into the screw hole 10, and the bolt 11 and hole 10 form floating height adjusting means as a whole.

Cutout windows 12, 12 are formed in the area onto which the tile 3 of the plate 2 is bonded and make the tile panel lighter in weight.

The plate 2 is bonded onto the back surface of the tile 3 with strong adhesive such as epoxy resin.

Figure 5:
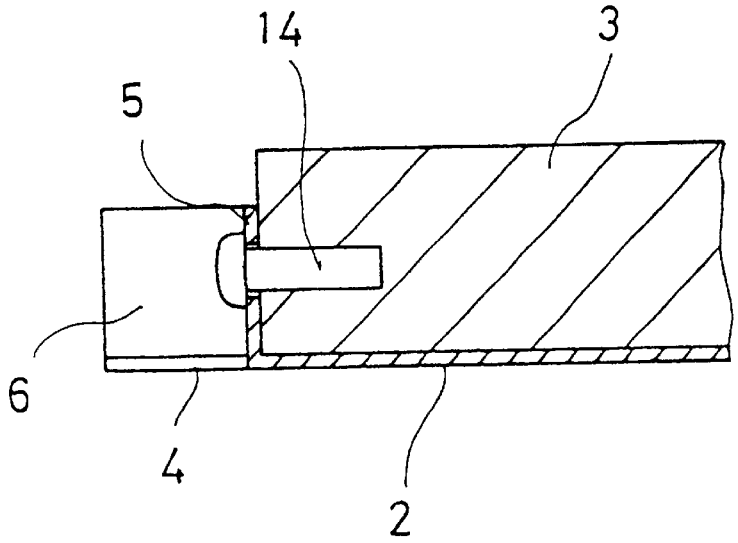
FIG. 5 is a crossectional view showing a state in which a raising piece is fixed to a tile.

A pin hole 13 is formed in the raising piece 5 which is fixedly attached to the sidewall of the tile 3 by a pin (rivet) 14 (see FIG. 5).

When the raising piece 5 is fixedly attached to the tile 3 with the pin 14, it is necessary to provide a screw driven hole 15 on the sidewall of the tile 3 in advance. If stone material is used for the tile 3, it is possible to protect the breakage of a main body by cutting a half-moon slit by a disk-shaped rotary grind stone, filling the slit with resin or the like and puncturing the resin.

Instead of specially cutting a slit, filling the slit with resin and puncturing the resin, it is also possible to bend the tip portion of the raising piece 5 inward, insert the bent portion to the slit and to thereby fixedly attach the raising piece 5 to the tile 3, though not shown.

Since a large tile of, in particular, ceramics is easily distorted during sintering, it is difficult to specify a reference side. The plate 2 is provided with the raising pieces 5, 5 at upper and lower edges thereof if the plate 2 is bonded onto the back surface of the tile 3. This makes it possible to use the raising piece 5 provided at, in particular, the lower edge, unify a positioning reference with respect to the tile 3 to the lower edge and to bond tiles so as to align the edges of the tiles laterally in execution.

In executing the wall surface using the tile panel, good workability is ensured if a horizontal plate member is fixedly attached to the lower edge of the wall surface and panel bonding starts at the lower-left end of the surface with reference to the upper edge of the plate member.

First, a tile panel to be bonded onto the wall surface is positioned lower-left and temporarily fixed with a screw nail 16 serving as a nail member screwed into the wall surface using a nail hole 9.

Since the nail hole 9 is penetrated into the thick restriction block 6, the screw nail 16 inserted into the nail hole 9 is held horizontally by the inner wall of the nail hole 9. Thus, when the screw 16 is screwed, it does not detach from a driver and fall down, whereby it is easily screwed into even a narrow joint successfully.

A tile panel arranged adjacent to the first tile panel, which has been temporarily fixed, on the right side is approached to the temporarily fixed first tile panel while bringing the restriction block 6 provided at the lower edge into contact with the upper edge of the plate member and sliding the block 6 to the left. If the distance between the two panels becomes equal to a joint width, the second tile panel is stopped there, positioned and temporarily fixed as in the case of the first panel.

Thereafter, tile panels are sequentially bonded onto the wall surface in right direction. After the tile panels are bonded onto the lowest stage on the surface entirely, the first tile panel to be bonded in the second stage is positioned and temporarily fixed on the lowest stage so that the restriction block 6 comes into contact with the upper edge of the first bonded tile panel and is not shifted horizontally.

Then, the second, third and the following tile panels are sequentially bonded (but in a temporary fixed state) onto the second stage of wall surface in right direction. After the tile panels are bonded onto the second stage on the wall surface entirely, panels are sequentially bonded onto the third and the following stages thereon.

As stated above, if the tile panels are tightly arranged adjacent to one another vertically, at least horizontal joints can be unified to have a fixed width by the restriction blocks.

As regards horizontal arrangement, at the time of positioning tile panels, the weight of tiles is used to allow the tile panels to be slightly shifted along the upper edge of the lower-side tile row, so that the panels can be easily arranged at predetermined joint width intervals almost perfectly.

Additionally, thanks to their large size, the tile panels can enjoy the above advantage.

The target wall surface onto which tiles are bonded may have both warped portions and undulated portions. Due to this, if tile panels are bonded onto the wall surface to be tightly attached onto the surface, slight differences in level may occur among adjacent tiles.

Taking this into consideration, even if the tile panels are uniformly arranged when they have been temporarily fixed, height adjustment is conducted to make the tile surface uniform instead of promptly, actually fixing them.

Figure 6:
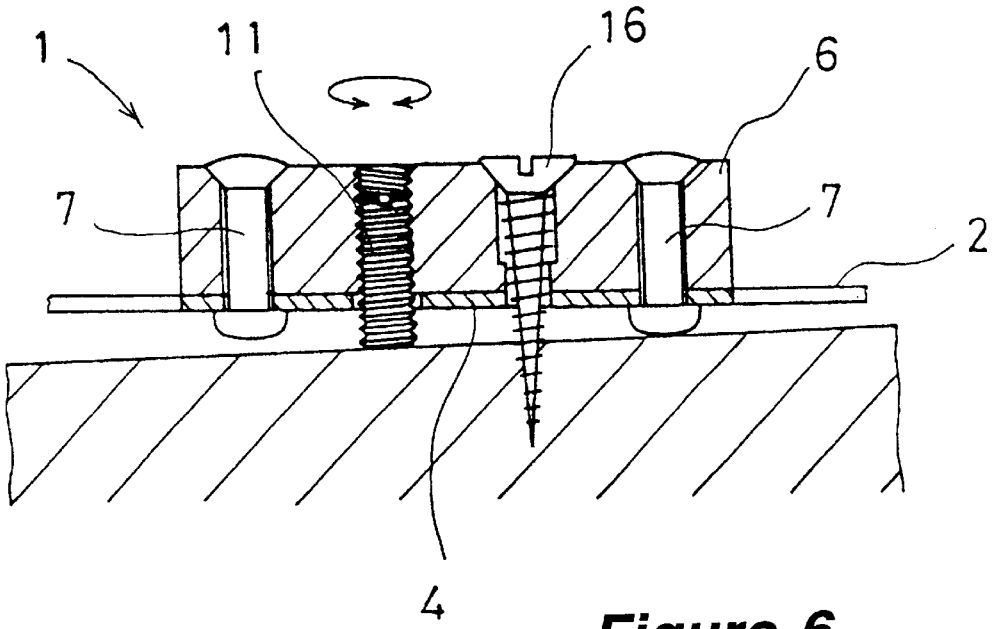
FIG. 6 is a crossectional view of an adjuster bolt.

The adjuster bolt 11 is incorporated into the restriction block 6. Thanks to this, a portion protruding in the forefront is found out over the scene. With the height used as a reference plane, if there is a portion lower than the reference plane, the tip end of the adjuster bolt 11 is pulled out of the bottom of the block 5 using a driver to thereby float the tile panel 1 off the wall surface and to adjust the height to the reference plane (see FIG. 6).

After the tile surface has been adjusted uniformly, all of the screw nails 16 are tightly screwed to surely fix the tile panels.

Thereafter, following the same procedures as those for ordinary tiling, i.e., mortar as joint filler is filled into clearances in such a manner that the mortar is coated on the surfaces including joints, the mortar left on the tile surface is wiped out and finished.

As can be seen from the above, the tile panels 1 according to the present invention are made by a dry execution method only by simply positioning the panel with the restriction block 6 brought into contact with lower tiles 3 using the own weight of the tiles 3 and then fixing them by screw nails 16 while the tile surface is slightly pressed and supported. The weight of the large tiles favors this execution, thereby making it possible to realize large-size tile dry execution which has not been realized so far.

Besides, there is almost no difference between the executed surface done by a beginner and that by an expert.

In the above embodiment, as shown in FIG. 3, the tile panels 1 are aligned both vertically and horizontally. However, since the position of the restriction block 6 is selected such that they do not interfere with one another even if they are arranged to be shifted vertically by a half length. The tile panel 1 according to the present invention can be adapted to any pattern.

Although not shown, it is possible to carry out the present invention to be applied to an English bond pattern or a French bond pattern in which two types of tiles, large and small, are combined in addition to the pattern in which tiles of same size are combined.

Moreover, even if adhesion power is weak, the lower edges of the tiles are fixedly bonded to the raising pieces 5 as shown in FIG. 5, in which respect the present invention is excellent in bonding property.

It is noted that the raising pieces 5 are not necessarily provided at upper and lower edges of the tiles and that they function sufficiently even if they are provided only at the lower edges.

Further, the number, positions and lengths of the restriction blocks 6 can be appropriately changed, if desired, as long as they do not overlap with one another. While they can be added to the side edges of the panels, at least the width of the restriction block 6 should be wider than the diameter of the head of a nail member.

Although there is no fear that the tile panels which have been bonded with nail members are peeled off, adhesive in addition to the nails can be used, nail fasteners and other fixing means in addition to the nails can be used or the nails can be changed to another means.

The tile panels 1 in this embodiment can be executed without any difference in level by using the adjuster bolts 11.

It is possible to use drive nails other than the screw nails to fix the tile panels.

It is true that good workability is ensured if tile panels are bonded from bottom to top; however it is not always required to bond tile panels from the lower left end. It is also possible to bond the panels on columns from top to bottom horizontally. It is possible to bond tile panels onto a target wall with reference to a column or a floor plane instead of the plate member.

Furthermore, if all of the tile panels 1 are temporarily fixed and then the floating heights are adjusted using the adjuster bolts 11 as described in the above-stated embodiment, the screw nails 16 used for temporary fixing need to be loosened once. If the heights of the individual tile panels 1 are adjusted and the tile panels 1 are fixedly bonded, then temporary fixing operation can be omitted.

If some tile panels 1 overlap with window regions or the portions onto which tile panels are not bonded yet are smaller in size than the tile panel, the tile panels according to the present invention cannot be used as they are. Instead, they can be cut and then used.

According to the present invention, the size and material of a tile 3, adhesive used for tiling and the like should not be limited to those described in the above-stated embodiment. The shapes and number of protruding pieces and restriction blocks 6 can be appropriately changed if desired. If the tiles 3 are rectangular, they are applicable to longitudinal bonding for arranging tiles longitudinally or lateral bonding for arranging tiles horizontally.

In addition, the design of the plate 2 can be appropriately changed so as not to depart from the sprit of the present invention. For example, a partly tiled plate, a plate divided into sections or cut windows are omitted so as to provide a lightweight tile panel. Not only mortar but also rubber, resin or the like can be used as material for joint filler.

The main object of the present invention is to improve workability by restricting the distance between joints using restriction blocks 6 and fixing the tile panels 1 onto a wall surface with nail holes 9 provided in the restriction blocks 6. In these respects, it is also possible to dispense with raising pieces 5 and floating height adjusting means and to fix the tile panels 1 directly onto the bonding positions without temporary fixing.

According to the tile panel of the present invention, if a tile 3 is bonded onto a plate 2, it can be accurately positioned with respect to the plate 2, thereby making it possible to remove irregularity and to thereby allow accurate tiling.

Moreover, by using these tile panels 1, if the restriction blocks 6 are kept in contact with adjacent tiles, it is possible to ensure providing uniform joints vertically.

Furthermore, if the raising pieces 5 provided at the lower edge of the plate 2 are fixed and attached to the side of the tile 3, there is no fear that the tile 3 may be peeled off even using adhesive of weak adhesion.

Also, if floating height adjusting means is provided in the restriction block 6, it is possible to form a uniform tile surface.

Finally, if a dry execution method for a wall surface according to the present invention is utilized, it is possible to carrying large tile dry execution tactfully and successfully.

What is claimed is:

1. A plurality of large-size tile panels for bonding onto a wall surface comprising:

a plate bonded onto a back surface of each of said tile panels;

said large-size tile panels arranged adjacent to one another on upper, lower, left and right sides and bonded onto said wall surface;

a plurality of restriction blocks disposed on coupling pieces of at least two opposite side edges of said plate in a tightly attached state;

said restriction blocks being positioned on said opposite side edges so as not to overlap with each other when said tile panels are aligned vertically and horizontally;

said restriction blocks having a thickness smaller than a thickness of one of said tile panels and having a width corresponding to a joint width;

said coupling pieces being formed to protrude beyond a tile bonding range on said plate; and a nail hole is provided in each of said restriction blocks.

2. The tile panels according to claim 1, wherein a raising piece is provided on a lower edge of the plate and fixedly attached to a side surface of each respective tile panel.

3. The tile panels according to claim 2, further comprising floating height adjusting means provided in each of the restriction blocks.

4. The tile panels according to claim 1, further comprises floating height adjusting means provided in each of the restriction blocks.

5. A method of providing tile panels for dry execution for a wall surface, comprising the steps of:

arranging a large-size tile panel adjacent to another tile panel;

providing restriction blocks on at least two opposite side edges of a plate of each tile panel through a coupling piece protruding beyond a tile bonding range;

contacting said restriction blocks of said tile panel with a side surface of the adjacent tile panel;

positioning said restriction blocks, on opposite side edges of said plate so as to not overlap each other when said tile panels are aligned vertically and horizontally;

providing each of said restriction blocks with a thickness larger than a thickness of a tile, a width corresponding to a joint width and a nail hole;

fixing each tile panel with a nail member inserted into said nail hole; and filling clearances among tiles with joint filler.

* * * * *